United States Patent [19]

Manne et al.

[11] 4,036,734

[45] July 19, 1977

[54] PROCESS FOR MANUFACTURING NAPHTHENIC SOLVENTS AND LOW AROMATICS MINERAL SPIRITS

[75] Inventors: Richard S. Manne; Sam R. Bethea; Edward A. Kelso, all of Baytown, Tex.

[73] Assignee: Exxon Research and Engineering Company, Linden, N.J.

[21] Appl. No.: 412,065

[22] Filed: Nov. 2, 1973

[51] Int. Cl.[2] ..... C10G 23/00

[52] U.S. Cl. ..... 208/57; 208/101; 208/102; 208/144; 260/667

[58] Field of Search ..... 208/14, 15, 57, 143, 208/144; 260/667

[56] References Cited

U.S. PATENT DOCUMENTS

| | | | |
|---|---|---|---|
| 1,948,378 | 2/1934 | Harding | 208/144 |
| 2,303,075 | 11/1942 | Frey | 208/144 |
| 2,917,448 | 12/1959 | Beuther et al. | 208/57 |
| 3,387,049 | 6/1968 | Craig et al. | 260/667 |
| 3,484,496 | 12/1969 | Carruthers et al. | 208/143 |

*Primary Examiner*—Herbert Levine
*Attorney, Agent, or Firm*—James E. Reed

[57] ABSTRACT

Naphthenic solvents and low aromatics mineral spirits are produced simultaneously by blending a hydrocarbon oil boiling in the range between about 100° F. and about 600° F. with an aromatics fraction having an initial boiling point similar to that of the oil to produce a blend containing in excess of about 10 weight percent aromatics, hydrogenating the blend in the presence of a hydrogenation catalyst until aromatics present in the blend have been converted into lower boiling naphthenic compounds, and thereafter fractionating the hydrogenated material to produce a highly naphthenic overhead fraction useful as a solvent and a low aromatics bottom fraction useful as mineral spirits.

16 Claims, 1 Drawing Figure

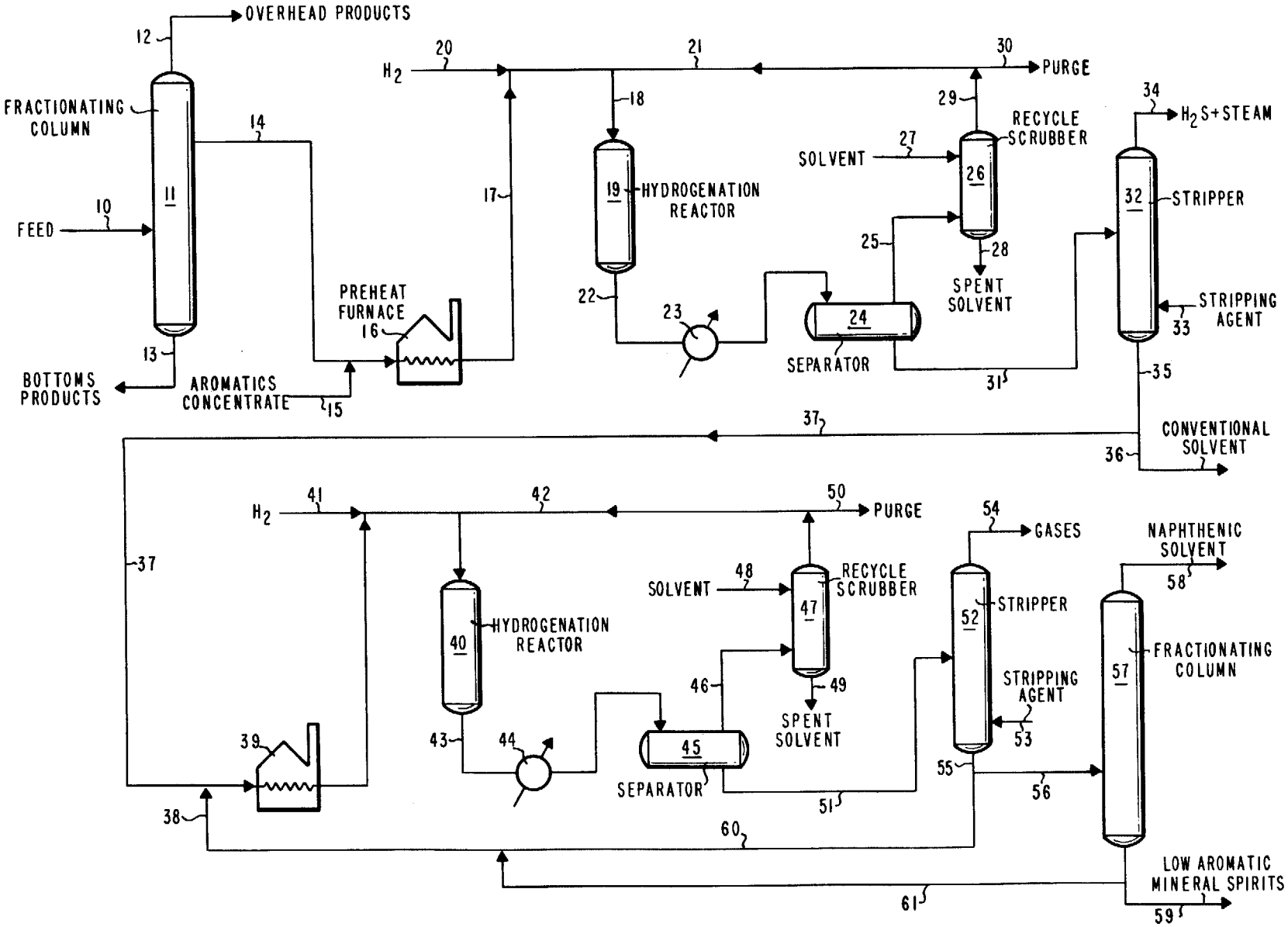
OVERHEAD PRODUCTS
FRACTIONATING COLUMN
FEED
BOTTOMS PRODUCTS
AROMATICS CONCENTRATE
PREHEAT FURNACE
$H_2$
HYDROGENATION REACTOR
SEPARATOR
SOLVENT
SPENT SOLVENT
RECYCLE SCRUBBER
PURGE
STRIPPER
STRIPPING AGENT
$H_2S$+STEAM
CONVENTIONAL SOLVENT
GASES
NAPHTHENIC SOLVENT
FRACTIONATING COLUMN
LOW AROMATIC MINERAL SPIRITS

PROCESS FOR MANUFACTURING NAPHTHENIC SOLVENTS AND LOW AROMATICS MINERAL SPIRITS

BACKGROUND OF THE INVENTION

1. Field of the Invention

This invention relates to the production of hydrocarbon solvents and is particularly concerned with a process for the simultaneous manufacture of naphthenic solvents and low aromatic mineral spirits.

2. Description of the Prior Art

Recent regulations restricting the use of aromatic hydrocarbons under conditions which may result in the loss of such hydrocarbons to the atmosphere have led to a demand for solvents which are essentially free of aromatic constituents. The relatively low solubility of many materials in normal paraffins and isoparaffinic hydrocarbons suggests that many such applications might be best served by the use of naphthenic solvents which generally have solvency values intermediate those of paraffins and aromatics. Large supplies of naphthenes are not readily available. It is known that aromatic compounds can be concentrated by extraction or adsorption on solid surfaces and then converted into naphthenic materials by hydrogenation. Processes for the manufacture of naphthenic solvents by this route pose problems, however, because of the highly exothermic nature of the aromatics hydrogenation reaction. The amount of heat released when aromatic concentrates are hydrogenated is so great that reactor temperatures become excessive unlss integral cooling is employed, staged reactors provided with intercooling are used, or the feedstock is highly diluted with hydrogenated product or a diluent that can subsequently be recovered by fractionation. These measures are all expensive and tend to make the cost of highly naphthenic, low aromatic solvents much higher than that of conventional solvents used in the past.

SUMMARY OF THE INVENTION

This invention provides an improved process for the simultaneous manfacture of naphthenic solvents and low aromatics mineral spirits which largely eliminates the difficulties associated with naphthenic solvent manufacturing processes suggested in the past. Im accordance with the invention, it has now been found that highly naphthenic liquid hydrocarbons which have low aromatics contents and are suitable for use as solvents and low aromatic fractions which are useful as mineral spirits can be prepared simultaneously by blending a hydrocarbon oil boiling between about 100° F. and about 600° F. with an aromatics fraction having an initial boiling point similar to that of the hydrocarbon oil to produce a blend containing in excess of about 10 weight percent aromatics, hydrogenating the resultant blend under conditions which result in the conversion of substantially all of the aromatics constituents into lower boiling naphthenic compounds, preferably in a single pass, and then fractionating the hydrogenated product to separate the lower boiling naphthenes from constituents present in the original blend. The naphthenic compounds produced during the hydrogenation step have boiling points which may be as much as 40° F. below those of their aromatic precursors and hence a highly naphthenic solvent which has a very low aromatics content and boils somewhat below the original blend can be recovered during the fractionation step.

The remaining material will generally have substantially the same boiling range as the original blend and will also have a low aromatics content. This material will comply with regulations limiting the aromatics content of mineral spirits and can be used as a hydrocarbon solvent, as a feedstock for other refinery processes, or for other purposes.

Any of a number of different petroleum fractions and similar hydrocarbon oils boiling between about 100° F. and about 600° F. can be employed in preparing the blends used as hydrogenation feedstocks in the process of the invention. Suitable streams include virgin naphthas, cracked naphthas, kerosenes, light gas oils, catalytic reformates, coker naphthas, and other distillates boiling in the 100 to 600° F. range. In general the use of narrow fractions which have boiling point spreads of from about 30° to about 50° F. and contain from about 10 to about 30 weight percent aromatic hydrocarbons is preferred. This use of a narrow cut results in the formation of naphthenic compounds which for the most part boil below the initial boiling point of the origina hydrogenation feedstock blend and thus permits the recovery of a solvent of higher naphthenic content than might otherwise be obtained. In some cases, however, it is advantageous to employ a stream with a broader boiling range so that a substantial proportion of the naphthenes produced will boil within the boiling range of the original blend and thus remain in the bottoms fraction recovered from the distillation step. This results in a bottoms product which has an enhanced naphthenes content and thus possesses greater solvent power than if aromatics had simply been removed by extraction or adsorption.

The aromatics fraction which is added to the hydrocarbon oil to produce the blend will normally be an aromatic concentrate having an initial boiling point similar to that of the hydrocarbon oil and will generally contain at least 50 weight percent aromatics, preferably in excess of about 90 weight percent aromatics. Aromatic fractions which have boiling point ranges similar to those of the hydrocarbon oils are normally used but fractions with narrower boiling point spreads can also be employed. Suitable concentrates can be obtained by solvent extraction, adsorption, molecular sieve separation or other conventional chemicals and refinery techniques. The aromatics fraction selected is added in an amount sufficient to produce a blend containing at least 10 weight percent aromatics. Blends containing from about 15 to about 50 weight percent aromatics are preferred.

Any of a number of conventional hydrogen treating techniques may be employed for the hydrogenation step of the process. Such techniques are generally similar to one another and differ primarily with respect to the catalyst employed. Suitable catalysts include nickel, platinum, rhenium, nickel tungstate, nickel molybdenum, molybdenum on alumina, cobalt molybdate on alumina, nickel molybdate on alumina, and the like. The contacting conditions employed will depend in part on the particular catalyst, feedstock blend and hydrogenation process used and may be varied as necessary. In general, however, temperatures in the range of from about 200° to about 700° F., pressures between about 100 and 2000 pounds per square inch gauge, feed rates of frm about 0.2 to about 10 volumes of feed per hour per volume of catalyst, and hydrogen treating rates between about 200 and about 3000 standard cubic feet per barrel of feed will be employed. The particular conditions selected should be sufficient to convert substantially all of the aromatics present in the blend into corresponding naphthenic constituents in a single pass through the hydrogenation unit. These naphthenic products will normally have boiling points ranging from a few degrees up to 40° or more below the boiling points of the corresponding aromatics from which they were produced.

The fractionation step of the process is carried out to effect a separation between constituents having boiling points similar to those of the original blended hydrogenation feedstock and the lower boiling naphthenic compounds. The overhead product from the fractionation step is thus a naphthenic fraction boiling somewhat lower than the blended feedstock. This fraction will consist primarily of naphthenes produced by the hydrogenation of aromatics but will also contain some low boiling paraffinic materials produced by cracking and subsequent hydrogenation reactions. The bottoms fraction will have a boiling range substantially the same as that of the hydrogenation feedstock blend and will normally be composed primarily of normal paraffins, isoparaffinic hydrocarbons and naphthenes present in the original blend. The aromatics content will be sufficiently low to comply with applicable regulations governing the aromatics in solvents and mineral spirits.

BRIEF DESCRIPTION OF THE DRAWING

The single FIGURE in the drawing is a schematic flow diagram of a process for the simultaneous manufacture of a highly naphthenic solvent and a mineral spirits product in accordance with the invention.

DESCRIPTION OF THE PREFERRED EMBODIMENTS

In the process depicted in the drawing, the hydrocarbon fraction employed as one component of the blend is obtained from a feedstock introduced into the system through line 10 to fractionating column 11. Here a cut of the desired boiling range is produced. The feedstock selected may be a heavy virgin naphtha, a catalytically cracked naphtha, a coker naphtha, a kerosene, a light gas oil, a catalytic reformate, a sievate produced by the contacting of a distillate fraction with a molecular sieve to eliminate normal paraffins, or a similar refinery stream, preferably one containing from about 10 to about 30 weight percent aromatics. Solvents normally have relatively narrow boiling ranges designed to meet particular specifications and hence fractionation to eliminate constituents boiling outside the range of interest will generally be required. Constituents boiling below the desired minimum are taken off overhead through line 12 and a bottoms fraction boiling above the range of interest is recovered through line 13. It will be understood, of course, that the fractionation step carried out in column 11 may be eliminated if a suitable hydrocarbon stream which has the required boiling rage is available.

A side strea for preparing the blended feedstock from which the naphthenic solvent and mineral spirits are to be manufactured in accordance with the invention is withdrawn from fractionating column 11 through line 14. The heat recovery and refluxing equipment normally associated with the withdrawal of such a side stream is not shown in the drawing. This side stream will ordinarily boil within the range between about 100° and about 600° F. and have a relatively narrow boiling point spread of between about 30° and about 50° F. The range and spread selected will depend in part upon the specifications for the naphthenic solvent and low aromatic mineral spirits to be produced. In general, the initial boiling point of the side stream should be approximately equal to the desired final boiling point of the naphthenic solvent. If a solvent boiling between 280° and 310° F. is to be produced, for example, a narrow cut side stream boiling between about 310° and about 350° F. may be employed. As will be pointed out in more detail hereinafter, the use of such a narrow cut fraction tends to maximize the recovery of naphthenic compounds in the solvent and inimize their presence in the low aromatics mineral spirits obtained in the process. In some cases it may be preferred, however, to employ a side stream having a somewhat broader boiling point spread in order to increase the naphthene content of the mineral spirits and thus improve their solvency.

The side stream withdrawn from column 11 through line 14 is combined with an aromatics fraction having a similar initial boiling point introduced into the system through line 15 and the resultant blend is fed into preheat furnace 16 where it is heated to the initial hydrogenation temperature. A blending tank not shown in the drawing may be provided to facilitate mixing of the two streams if desired. The aromatics fraction will normally be a concentrate containing at least 50 weight percent aromatics and will preferably contain 90% or more aromatics by weight. This aromatics-rich material maybe obtained by the extraction or adsorption of aromatics fromm feed streams to be used for other purposes, by the separation of aliphatic compounds from naphthas and similar materials through the use of molecular sieves, or as a by-product of other chemical and refining processes. The amount of such material added will be governed in part by the amount of exothermic heat of reaction which can be tolerated under the particular hydrogenation process conditions employed, which may in turn depend upon factors such as the amountof product, if any, to be recycled as diluent to the hydrogenation step. The aromatics concentration in the blended feedstock corresponding to the maximum allowable heat increase during hydrogenation can be readily calculated by methods known to those skilled in the art and used to determine the maximum naphthenes concentration in the product solvent. In general, however, it is preferred that the total aromatics content of the blend fed to the hydrogenation step be maintaned at a level between about 15 and about 50% by weight.

The process shown in the drawing includes two hydrogenation stages, an initial stage in which the blended feedstock is subjected to a relatively mild hydrogen treatment for the removal of sulfur, oxygen and nitrogen compounds and the saturation of olefins and a second, more severe stage in which aromatics are saturated to produce naphthenic compounds. Such a two-stagehydrogenation treatment is not always essential, however, and in some cases, particularly where the sulfur content of the initial feedstock is low, it may be preferred to employ a single-stage hydrogenation treatment to improve the stability of the blended feedstock and convert the aromatic constituents into naphthenic compounds simultaneously.

In the process shown in the drawing, the preheated feedstock blend from preheat furnace 16 is passed through lines 17 and 18 into initial hydrogenation reactor 19, along with makeup hydrogen fed into the system through line 20 and recycle hydrogen introduced through line 21. The blended feedstock and hydrogen thus introduced are contacted in the reactor with a hydrogenation catalyst such as nickel, platinum, rhenium, nickel tungstate, nickel molybdenum, molybdena on alumina, cobalt molybdate on alumina, nickel molybdate on alumina, or the like. A variety of commercial hydrogenation catalysts are available from catalyst manufacturers and may be used. The catalyst may be maintained in either a fixed or moving bed. Conventional hydrogenation processes for the removal of sulfur, oxygen and nitrogen compounds and the stabilization of naphthas, middle distillates and similar fractions using both fixed bed and moving bed techniques have been described in the literature and will be familiar to those skilled in the art. The particular process employed will depend in part on the boiling rage of the feedstock blend to be treated, the amount of sulfur and other unstable constituents present, and other factors. In general, however, it is normally preferred to employ a fixed bed process utilizing relatively mild hydrogenation conditions.

The initial hydrogenation step will normally be carried out at a temperature in the range between about 400° F. and about 600° F., a pressure in the range between about 100 and about 1500 psig, a feed rate between about 0.5 and about 10 volumes of feed per hour per volume of catalyst and a hydrogen treat rate of from about 200 to about 2000 standard cubic feet per barrel of feed. Naphthas and similar relatively low-boiling fractions of moderately low sulfur content can generally be treated at conditions near the lower ends of these ranges to produce materials with acceptable stability levels; whereas higher boiling fractions and those containing relatively large quantities of sulfur and other unstable constituents will normally require somewhat more severe hydrogenation conditions. The efficiency of the particular catalyst employed will also affect to a considerable extent the conditions required for the production of an acceptable hydrogenated product. In general, it is preferred that the hydrogenated material obtained from the initial hydrogenation step have a Saybolt color of +30 or better; a copper-strip corrosion value, determined over 3 hours at 212° F., of 1 or better; a sulfur content of 10 parts per million or less; and acceptable odor. Other characteristics such as boiling point range, flash point, API gravity and aniline point will depend upon the feedstocks employed and the applicable specifications for the particular solvent and aromatic spirits to be produced in the process.

The hydrogenated effluent withdrawn from hydrogenation reactor 19 is passed through line 22 and cooler 23 to liquid gas separator 24. Hydrogen-containing gases and hydrogen sulfide are taken off overhead from the separator through line 25 and will normally be scrubbed in recycle scrubber 26 with a solvent such as triethanolamine introduced through line 27. The spent solvent is withdrawn from the scrubber through line 28 and may be regenerated in the conventional manner. The scrubbed gases, composed primarily of hydrogen, are taken overhead from the scrubber through line 29 and recycled to the hydrogenation reactor by means of line 21. In order to maintain the hydrogen concentration of the recycle gases within acceptable bounds, a portion of the recycle gases are withdrawn from the system through line 30.

The liquid constituents from liquid-gas separator 24 are withdrawn through line 31 and passed to stripper 32 where steam or other stripping agent is introduced by means of line 33 to drive off hydrogen sulfide. The hydrogen sulfide and spent stripping agent maybe taken off overhead through line 34 and a low sulfur hydrocarbon fraction is withdrawn by means of line 35. This fraction will normally have a somewhat lower aromatics content than the initial blended feedstock and will contain only very small quantities of olefins and sulfur, oxygen and nitrogen compounds. If desired, a portion of this material may be withdrawn from the system through line 36 for use as a conventional solvent in applications where the aromatics present can be tolerated.

The hydrogen treated material which is not withdrawn for use as a conventional solvent is passed through line 37 to the second stage hydrogenation step of the process. Here the previously treated material and any recycle solvent introduced from line 38 is passed through preheat furnace 39 and fed into hydrogenation reactor 40, aling with hydrogen introduced through line 41 and recycle gas from line 42. The catalyst and hydrogenation process used in reactor 40 will normally be similar to those in reactor 19 but the conditions employed will generally be somewhat more stringent in order to ensure substantially complete conversion of aromatics in the blended feedstock to naphthenes. Depending upon the particular catalyst used and the aromatics concentration in the incoming feed material, the temperature in reactor 40 will generally range between about 300° F. and about 600° F., the pressure will normally be between about 250 and about 2000 pounds per square inch, the feed rate will vary from about 0.2 to about 5 volumes of feed per hour per volume of catalyst, and the hydrogen treat rate will normally be between about 500 and about 3000 standard cubic feet per barrel of feed. The conditions selected will preferably be such that substantially all the aromatics will be converted to naphthenes in a single pass through the reactor and a product containing less than about 1% aromatics by weight will be recovered.

The hydrogenation reaction carried out in reactor 40 results in the conversion of aromatic compounds into naphthenes having boiling points which range from a few degrees to as much as 40° lower than those of the corresponding aromatic precursors. The boiling points of representative alkyl benzenes and the corresponding alklycyclohexanes, for example, are shown in the following table:

TABLE I

Boiling Points of Alkyl Benzenes and Alkyl Cyclohexanes

| Alkyl Group, X- | X-Benzene, Boiling Pt., ° F. | X-Cyclohexane, Boiling Pt., ° F. |
|---|---|---|
| 1,2-dimethyl- | 291 | 253-266 |
| 1,3-dimethyl- | 282 | 248-255 |
| 1,4-dimethyl- | 280 | 246-255 |
| Ethyl- | 277 | 270 |
| 1,2,3-trimethyl- | 349 | 291-307 |
| Propyl- | 318 | 315 |
| Isopropyl- | 306 | 311 |
| 1,3-dimethyl-5-ethyl- | 363 | 336 |
| 1-methyl,2-propyl- | 363 | 349 |
| 1,3-diethyl- | 358 | 345 |

The effluent from the reactor thus comprises a low aromatics fraction having a boiling range substantially the same as that of the reactor feedstock, a lower boiling fraction containing naphthenes and other constituents, and a mixture of hydrogen with some gaseous hydrocarbons produced during the reaction. This effluent is passed through line 43 and heat exchanger 44 to liquid gas separator 45. Here the gaseous products are taken off overhead through line 46. If a significant amount of hydrogen sulfide is present, the gas stream may be scrubbed in recycle scrubber 47 with an ethanolamine or similar solvent introduced through line 48 in order to remove the hydrogen sulfide and thus avoid adverse effects upon the hydrogenation catalyst. The spent solvent may be recovered by way of line49 and the treated line 49 gas can be recycled to the reactor through line 42. A portion of the gas stream is purged through line 50 to maintain the hydrogen concentration within acceptable bounds.

The liquid stream from the liquid-gas separator is transferred through line 51 to stripper 52 where steam or other stripping agent introduced through line 53 may be used to remove dissolved gases. The gases and stripping agent may be taken off overhead through line 54. The liquids are withdrawn from the bottom of the stripper through line 55. This material is then passed through line 56 to fractionating column 57 where the lower boiling naphthenic solvent is taken off overhead through line 58 and low aromatics mineral spirits having substantially the same boiling range as the original blended feed to the hydrogenation process is recovered as a bottoms product through line 59. The naphthenic solvent will preferably have an aromatics content less than about 0.5% by weight and a naphthenes content of about 60% or higher. The aromatics content of the mineral spirits fraction will also generally be quite low, permitting its use as a "complying" solvent in a wide variety of applications where highly aromatic materials cannot be used.

The heat rise which takes place in reactor 40 during the hydrogenation step is dependent upon the amount of aromatic compounds present in the feed to the reactor. Knowing the maximum temperature rise which can be tolerated with the particular equipment being used, the upper limit on the aromatics concentration in the blended feed can be readily calculated. If the amount of aromatics in the blend is high, a portion of the liquid product withdrawn from stripper 52 can be recycled through line 60 and line 38 to the feed stream. Alternatively, a portion of the low aromatic mineral spirits withdrawn through line 59 can be recycled through lines 61 and 38 for use as a diluent to the blended feed stream.

The nature and objects of the invention are further illustrated by the following examples.

EXAMPLE 1

A petroleum naphtha fraction which boiled between about 316° F. and about 355° F. and contained 13.4 weight percent aromatics was blended with a concentrate consisting essentially of aromatics boiling within about the same range to produce a blend containing 30 weight percent aromatics. This blend was hydrogenated over a commercial hydrogenation catalyst at a temperature of 575° F. The hydrogenation reaction was carried out under nominally isothermal conditions at a pressure of 300 pounds per square inch gauge, a space velocity of 2 volumes per hour per volume of catalyst, and a hydrogen feed rate of 1000 standard cubic feet per barrel. The hydrogenated product from this reaction was then fractionated at atmospheric pressure with a 10/1 reflux ratio in a 15 plate true boiling point still to obtain 0 to 27% and 27 to 100% fractions. The properties of the feed material and the fractions recovered following the hydrogenation reaction are set forth in Table II below.

TABLE II

| Naphthenic Solvent and Mineral Spirits from Blended Feedstock | | | | |
|---|---|---|---|---|
| | Feedstock Components | | Hydrogenated Product from Feed Blended to 30% Aromatics | |
| | Naphtha | Aromatics Concentrate | 0–27% | 27–100% |
| Gravity, ° API | 50.7 | 30.5 | 50.1 | 52.3 |
| IBP, ° F | 316 | 312 | 280 | 318 |
| 50% Point, ° F. | 328 | 320 | 290 | 330 |
| FBP, ° F. | 355 | 346 | 319 | 362 |
| Aromatics, wt. % | 13.4 | >98 | 0.4 | 3.9 |
| Naphthenes, wt. % | 21.5 | — | 80.2 | — |

Notes:
1. Hydrogenation carried out at 575° F. over commercial hydrogenation catalyst - 2 V/Hr./V; 300 psig; 1000 SCF $H_2$/B.
2. Operation equivalent to 2 pass operation or 50% product recycle; calculated $\Delta T = +125°$ F. per pass.

It will be noted from the above the table that hydrogenation of the blended feedstock containing 30% aromatics yielded a hydrogenated overhead product which was equivalent to 27 volume percent of the original blended feedstock and contained about 80% naphthenes. This overhead fraction boiled between 280° and 319° F. and thus had a boiling range significantly lower than either of the streams used in preparing the blended feedstock fed to the hydrogenation step of the process. This illustrates the production of lower boiling naphthenes by the hydrogenation of aromatics and shows that the naphthenic compounds thus produced can be readily recovered in high concentrations for use as a highly naphthenic solvent. The bottoms fraction recovered from the final fractionation step had substantially the same boiling range as the blended feedstock and contained only 3.9 weight percent aromatics. This material is thus suitable for use as a low aromatics mineral spirits product in applications where the use of highly aromatic materials is precluded.

EXAMPLE 2

A run similar to that described in Example 1 above was carried out by blending 38.2 volume percent of a petroleum naphtha, 14.6 volume percent of an aromatic concentrate boiling within the same range as the naphtha fraction but having a somewhat lower end point, and 46.2 volume percent of a simulated recycle stream prepared earlier by hydrogenating a mixture of the same naphtha and aromatics concentrate. The resultant blend contained 15.6 weight percent aromatics. This blend was then hydrogenated at a temperature of about 435° F. over a commercial hydrogenation catalyst using a feed rate of 2.0 V/hr./V, a pressure of 540 psig, and a hydrogen rate of 1000 SCF/bbl. The hydrogen employed was of 62% purity. The hydrogenated product contained 4.0 volume percent aromatics, 57.2 volume percent naphthenes, and 36.9 volumepercent paraffins. This product was fractionated in a 15 plate equivalent packed column at a 10/1 reflux ratio and 40 mm of mercury absolute pressure to give a 32% yield of an 80.9 volume percent naphthenic solvent. The atmospheric pressure equivalent top vapor temperature cut point was 319° F. The inspections of the feed and product streams are set forth in Table III below.

TABLE III

Naphthenic Solvent and Mineral Spirits from Blended Feedstock and Recycle

| | Feedstock | | | Products | |
|---|---|---|---|---|---|
| | Naphtha | Aromatics Concentrate | Blend + Recycle | 0–32% Fraction | 32–100% Fraction |
| Aniline Point, ° F. | — | — | — | 128.5 | 147.7 |
| Color, Saybolt | +30 | — | — | +30 | +30 |
| Corrosion, Copper Strip, 3 Hrs. at 212° F. | — | — | — | 1.1 | 1.2 |
| Distillation, D-86 | | | | | |
| IBP | 314 | 315 | — | 272 | 343 |
| 50% | 353 | 320 | — | 290 | 357 |
| FBP | 390 | 353 | — | 316 | 401 |
| Residue, Vol. % | 1 | 1 | — | 1 | — |
| Doctor Test | — | — | — | Pass | Pass |
| Flash Point, ° F. | 105 | — | — | 78 | 121 |
| Gravity, API | — | 30.6 | — | 49.5 | — |
| Sulfur, PPM | <1 | — | — | <1 | <1 |
| Aromatics, Vol. % | 17.1 | 98.6 | 15.6 | 2.1 | 4.3 |
| Naphthenes, Vol. % | 35.2 | 0.2 | — | 80.9 | 48.2 |

Again it will be noted that the naphthenic fraction boiling below the boiling range of the blended feedstock had a very high naphthenes content and a low aromatics content. The volatility characteristics of this fraction were similar to those of solvents marketed commercially and hence the material can be employed as a naphthenic solvent with little or no additional treatment. The bottoms fraction also had an enhanced naphthenes content and a low aromatics content and was thus more suitable for use as mineral spirits than a material obtained by simply removing aromatics from a naphtha or similar fraction by adsorption or extraction.

Additional runs similar to those reported above have been carried out with other starting materials and different hydrogenation conditions. The results of these tests have shown that the process of the invention provides a simple and economical method for the manufacture of naphthenic solvents and that this method has pronounced advantages over processes available in the past. It permits the simultaneous production of low aromatics fractions which are useful as mineral spirits and will comply with regulations restricting the use of highly aromatic materials.

We claim:

1. A process for the simultaneous production of a naphthenic hydrocarbon liquid useful as a naphthenic solvent and a low aromatics hydrocarbon liquid useful as mineral spirits which comprises blending a hydrocarbon oil boiling within the range between about 100° F. and about 600° F. with an aromatics concentrate which contains at least 50 weight percent aromatics compounds, has an initial boiling point about the same as that of said hydrocarbon oil, and boils within the range between about 100° F. and about 600° F., said hydrocarbon oil having a lower aromatics content then said aromatics concentrate, to produce a blend containing in excess of about 10 weight percent aromatic compounds; hydrogenating said blend in the presence of a hydrogenation catalyst under conditions sufficient to convert aromatics present in said blend into lower boiling naphthenic compounds; fractionating the hydrogenated blend; and recovering a highly naphthenic overhead fraction containing naphthenic constituents boiling below the initial boiling points of said hydrocarbon oil and said aromatics concentrate and a bottoms fraction of low aromatics content containing constituents present in said blend prior to hydrogenation.

2. A process as defined by claim 1 wherein said hydrocarbon oil is a petroleum fraction containing from about 10 to about 30 weight percent aromatics.

3. A process as defined by claim 1 wherein said hydrocarbon oil has a boiling point spread of from about 30° to about 50° F.

4. A process as defined by claim 1 wherein said aromatics concentrate contains in excess of about 90% aromatics by weight.

5. A process as defined by claim 1 wherein said blend contains from about 15 to about 50% aromatics by weight prior to hydrogenation.

6. A process as defined by claim 1 wherein said blend is hydrogenated in two stages, an initial stage for the removal of sulfur, oxygen and nitrogen compounds and the saturation of olefins and a final stage for the conversion of aromatic compounds into naphthenic compounds.

7. A process as defined by claim 1 wherein said aromatics concentrate has a narrower boiling point spread than said hydrocarbon oil.

8. A process as defined by claim 1 wherein said bottoms fraction has a boiling range substantially the same as that of said blend prior to hydrogenation.

9. A process as defined by claim 1 wherein said blend is hydrogenated at a temperature in the range between about 200° F. and about 600° F., a pressure in the range between about 100 and about 2000 psig, a feed rate of from about 0.2 to about 10 volumes of feed per hour per volume of catalyst, and a hydrogen treat rate between and 200 and about 3000 SCF per hour per barrel of feed.

10. A process as defined by claim 6 wherein portion of the hydrogenated blend from said first hydrogenation stage is withdrawn for use as a solvent and the rest of said hydrogenated blend from said first hydrogenation stage is passed to said second hydrogenation stage.

11. A process as defined by claim 1 wherein a portion of said bottoms fraction is recycled as feed to the hydrogenation step.

12. A process as defined by claim 1 wherein a portion of the hydrogenated blend from the hydrogenation step is recycled as feed to said hydrogenation step and the rest of said hydrogenated blend is fractionated for the recovery of said overhead and bottoms fractions.

13. A process for the manufacture of a naphthenic solvent and a low aromatics mineral spirits which comprises blending a petroleum fraction boiling in the range between about 100° and about 600° F. and containing from about 10 to about 30 weight percent aromatics with an aromatics concentrate which boils between about 100° F. and about 600° F., has an initial boiling point about the same as that of said petroleum fraction, and contains in excess of about 90% aromatics by weight to produce a blend containing from about 15 to about 50% aromatic compounds by weight; hydrogenating said blend in the presence of a hydrogenation catalyst until aromatic compounds in said blend have been converted into lower boiling naphthetic compounds; and thereafter fractionating the hydrogenated blend into an overhead fraction containing naphthenic compounds boiling below the initial boiling points of said petroleum fraction and said aromatics concentrate and a low aromatics bottoms fraction having a boiling range substantially the same as that of said blend prior to hydrogenation.

14. A process as defined by claim 13 wherein said petroleum fraction has a boiling point spread of from about 30° to about 50° F.

15. A process as defined by claim 13 wherein said blend is hydrogenated in a first hydrogenation stage for the removal of sulfur, oxygen and nitrogen compounds and the saturation of olefins and in a second hydrogenation stage for the conversion of aromatics into naphthenic compounds.

16. A process as defined by claim 13 wherein said aromatics concentrate has a boiling point spread substantially the same as that of said petroleum fraction.

* * * * *